US009970402B2

(12) United States Patent
Fischer et al.

(10) Patent No.: US 9,970,402 B2
(45) Date of Patent: May 15, 2018

(54) SYSTEM HAVING A FUEL DISTRIBUTOR AND A MOUNTING SUPPORT

(71) Applicant: Robert Bosch GmbH, Stuttgart (DE)

(72) Inventors: Michael Fischer, Niefern-Oeschelbronn (DE); Andreas Rehwald, Bietigheim-Bissingen (DE); Michael Mayer, Wannweil (DE); Matthias Maess, Boeblingen (DE); Goekhan Guengoer, Eberdingen (DE); Venkatesh Kannan, Novi, MI (US)

(73) Assignee: ROBERT BOSCH GMBH, Stuttgart (DE)

( * ) Notice: Subject to any disclaimer, the term of this patent is extended or adjusted under 35 U.S.C. 154(b) by 66 days.

(21) Appl. No.: 13/871,561

(22) Filed: Apr. 26, 2013

(65) Prior Publication Data

US 2013/0284152 A1 Oct. 31, 2013

(30) Foreign Application Priority Data

Apr. 26, 2012 (DE) ..... 10 2012 206 931

(51) Int. Cl.

| | |
|---|---|
| ***F02M 69/46*** | (2006.01) |
| ***F02M 55/04*** | (2006.01) |
| ***F02M 55/02*** | (2006.01) |

(52) U.S. Cl.

CPC ..... *F02M 69/46* (2013.01); *F02M 55/025* (2013.01); *F02M 55/04* (2013.01); *F02M 69/465* (2013.01); *F02M 2200/09* (2013.01); *F02M 2200/85* (2013.01); *F02M 2200/857* (2013.01)

(58) Field of Classification Search

CPC ..... F02M 55/04; F02M 2200/85; F02M 2200/857; F02M 69/46

USPC ..... 123/447, 456, 468, 469, 470

See application file for complete search history.

(56) References Cited

U.S. PATENT DOCUMENTS

| | | | | |
|---|---|---|---|---|
| 6,178,950 | B1 * | 1/2001 | Stockner | F02M 55/025 123/469 |
| 6,340,019 | B1 * | 1/2002 | Eshleman | F02M 69/465 123/469 |
| 7,078,104 | B2 * | 7/2006 | Dunlap | C08J 3/244 428/450 |

(Continued)

FOREIGN PATENT DOCUMENTS

| | | |
|---|---|---|
| DE | 102005009740 | 9/2006 |
| DE | 10 2008 044 165 | 6/2010 |

(Continued)

*Primary Examiner* — Hung Q Nguyen
*Assistant Examiner* — Kevin R Steckbauer
(74) *Attorney, Agent, or Firm* — Norton Rose Fulbright US LLP; Gerard Messina

(57) ABSTRACT

A system, which may be embodied particularly as a fuel injection system for high pressure injection in internal combustion engines, includes a fuel distributor and a mounting support, which is used for fastening the fuel distributor to an externally-mounted structure, particularly a cylinder head, of an internal combustion engine. In this case, a damping composite element is provided, which is connected to the mounting support and/or the fuel distributor. The damping composite element includes at least one metal layer, which is formed at least essentially of a metallic material, and at least one elastically deformable damping layer.

32 Claims, 4 Drawing Sheets

(56) References Cited

U.S. PATENT DOCUMENTS 7,591,246 B2 * 9/2009 Beardmore ..... F02M 55/025 123/456
7,980,226 B2 * 7/2011 Hunt ..... F02M 55/025 123/456
8,276,528 B1 * 10/2012 Higgins ..... F23C 9/00 110/104 R
8,307,809 B2 * 11/2012 Hay ..... F02M 55/025 123/198 E
8,701,632 B2 * 4/2014 Solferino ..... F02M 61/14 123/470
8,739,763 B2 * 6/2014 Harvey ..... F02M 61/14 123/470
8,800,534 B2 * 8/2014 Kannan ..... F02M 61/168 123/468
8,844,502 B2 * 9/2014 Solferino ..... B23P 19/00 123/456
8,875,681 B2 * 11/2014 Kannan ..... F02M 61/168 123/456
9,664,164 B2 * 5/2017 Imakita ..... F02M 55/025
2007/0163545 A1 * 7/2007 Beardmore ..... F02M 55/025 123/456
2007/0175451 A1 * 8/2007 Beardmore ..... F02M 61/14 123/470
2008/0230969 A1 * 9/2008 Yoshii ..... F16F 13/06 267/140.13
2010/0242916 A1 * 9/2010 Hunt ..... F02M 55/025 123/469
2011/0073074 A1 * 3/2011 Hay ..... F02M 55/025 123/456
2012/0204837 A1 * 8/2012 Harvey ..... F02M 55/02 123/469
2013/0104852 A1 * 5/2013 Kannan ..... F02M 61/168 123/456
2013/0125864 A1 * 5/2013 Kannan ..... F02M 61/168 123/469
2014/0027543 A1 * 1/2014 Solferino ..... F02M 61/14 239/533.2
2014/0123951 A1 * 5/2014 Imakita ..... F02M 55/025 123/469
2015/0083082 A1 * 3/2015 Pohlmann ..... F02M 61/14 123/445
2015/0204295 A1 * 7/2015 Wiedmann ..... F02M 55/025 123/456

FOREIGN PATENT DOCUMENTS

DE 102008044165 A1 * 6/2010 ..... F02M 61/14
EP 2 034 172 3/2009
EP 2 236 808 10/2010
WO WO 9212006 A1 * 7/1992 ..... B32B 15/08
WO WO 2008/064970 6/2008
WO WO 2008064970 A1 * 6/2008 ..... F02M 55/02

* cited by examiner

SYSTEM HAVING A FUEL DISTRIBUTOR AND A MOUNTING SUPPORT

FIELD OF THE INVENTION

The present invention relates to a system, particularly a fuel injection system for high-pressure injection in internal combustion engines, having a fuel distributor and at least one mounting support which is used to fasten the fuel distributor to an externally-mounted structure, especially of the internal combustion engine.

BACKGROUND INFORMATION

A fuel-injection device is described in German Published Patent Application No. 10 2005 009 740. The known fuel-injection device is characterized by a sound-decoupling design. In this instance, a fuel distributor line is fastened to a cylinder head of an internal combustion engine using connecting means. In the area of the connecting means, at least one damping disk is provided in each instance. The damping disks are used for the decoupling, and may be situated in the region below the bolthead having seating directly on the fuel distribution line or having seating directly on the cylinder head, so that the high-pressure injection system, made up of the fuel distribution line and a plurality of fuel injection valves, is more effectively decoupled with respect to the cylinder head and is better sound-insulated.

The fuel injection device described in German Published Patent Application No. 10 2005 009 740 has the disadvantage that a prestressing of the damping disk or damping disks is generated via the tightening torque of the connecting means which, over the life cycle, leads to fatigue in the material of the damping disk or damping disks. In addition, there is a dependence on the tightening torque, or rather, this has to be maintained precisely. If the tightening torque is too large, there will be premature fatigue of the damping disk. On the other hand, if the tightening torque is too low, because of the play, it may come to premature wear of the components, especially in the fastening range, based on shock and vibrations.

SUMMARY

The system according to the present invention has the advantage of ensuring improved vibrational damping over the service life. In particular, there is the advantage that sufficient noise damping is ensured even after a high operating duration.

The system is especially suitable for internal combustion engines having direct gasoline injection. In this case, the fuel distributor may be designed in particular as a fuel manifold. On the one hand, the fuel distributor may be used for distributing the fuel to a plurality of fuel injectors, especially high-pressure injectors. On the other hand, the fuel distributor may be used as an in-common fuel reservoir for the high pressure injectors. The injectors are connected to the fuel distributor in a suitable manner and they then spray the fuel required for the combustion process into the respective combustion chamber under high pressure. The fuel is compressed, in this instance, by a high-pressure pump and, controlled as to quantity, is conveyed into the fuel distributor via a high-pressure line.

The system may advantageously be designed as a fuel injection system. In this case, the mounting device may be used to fasten the fuel distributor to the internal combustion engine, or even to another externally-mounted structure. The externally-mounted structure, particularly the internal combustion engine is not necessarily a component of the system. In particular, the system, particularly the fuel injection system, may also be produced and marketed independently of an externally-mounted structure or an internal combustion engine.

The fuel distributor is able to be excited to vibrations in the audible frequency range during operation. This may happen above all by noise sources in the high pressure injectors, which may be components of the fuel injection system. The structure-borne noise, in this instance, spreads from the high pressure injectors, for example, via rail bucket tappets, the fuel distributor and one or more mounting supports to the externally-mounted structure, from where disturbing noises may be radiated which, under certain circumstances, may even penetrate into the interior of the vehicle. Such disturbing noises may, however, be damped by the damping composite element.

Thereby, in particular, a noise nuisance in the interior of the vehicle may be avoided.

The externally-mounted structure may advantageously be formed by a cylinder head of the internal combustion engine. One may also, however, provide a connection via spacer sleeves or via further connecting elements. In principle, disturbing airborne noise may be radiated directly from the outside of the fuel distributor, especially when the fuel distributor has been mounted in an exposed manner on an engine structure. By connecting the damping composite element to the fuel distributor, noise damping may be ensured in this regard.

Consequently, advantageous noise damping may be achieved by one or more damping composite elements with regard to a respective application case. Depending on the application case, the damping in this case may take place in the area of the fuel distributor or both in the area of the mounting support and in the area of the fuel distributor.

Another advantage is that the damping composite element does not necessarily have prestressing applied to it. As the case may be, the damping composite element may also be acted upon only locally, in the area of a fastening location. Thus, the elastically deformable damping layer does not experience any prestressing. This has a favorable effect on noise damping over the service life. In addition, there is a greater degree of freedom for the selection of material for the elastically deformable damping layer.

The damping composite elements also enable a vibration technology damping, without the stiff connection, with regard to rigidity and functioning, of the fuel distributor via the mounting support to the externally-mounted structure having to be reduced in comparison to a firmly screwed connection. In one effective embodiment, which may be implemented by a cover on mounting supports that are designed in sheet metal form, a reduction in the structure-borne noise components transmitted into the externally-mounted structure, particularly the cylinder head, may be implemented at the same time. A structure-dynamic partial decoupling is able to be ensured by this.

The damping composite elements may be adjusted in their size and number to the respective application case. High requirements with regard to noise emission may be satisfied thereby for acoustical improvement. In this case, a great damping of modes of vibration of the fuel distributor, and the amplitude reduction of these modes of vibration, that goes with it, may be achieved. The damping composite elements may be applied on the surface, in this instance. The elastically deformable damping layer may be designed as an elastomer layer and a connection of the damping layer with at least one metal layer of the damping composite element or a bordering outer side of the fuel distributor may be produced by vulcanizing it on. By doing this, great damping of the vibrations may be combined with high reliability. Consequently, the damping layer of the damping composite element is able to be combined with the mounting support and/or the fuel distributor by vulcanization. The damping layer is advantageously formed of a material based on a rubber, in this case. The term rubber should be taken quite generally in this case, and besides natural rubber also includes synthetic rubber materials.

The mounting support may be connected as a continuous material to the fuel distributor. In this context, the mounting support may advantageously be soldered to the fuel distributor. Applying the solder connection may take place in a conveyor furnace. Subsequently, the damping composite element may be connected to the mounting support and/or the fuel distributor. Consequently, an impairment of the material of the damping layer is prevented from the start by the soldering process. Other possibilities for connecting the mounting support to the fuel distributor are also conceivable, particularly welding.

The damping composite element may advantageously be designed as a sandwich construction. In this instance, one or more damping layers are joined together with one or more metal layers to form a composite. The metal layers and the damping layers alternate preferably, in this case, and are connected to one another in a suitable manner.

A mechanical operating principle for vibration reduction is able to be implemented in an advantageous manner by the damping composite element. Between two or more metal layers, one or more preferably viscoelastic damping layers may be laminated together or vulcanized. The metal layers may, in this case, be made of sheet metal. The elastically deformable damping layer lying in between is dynamically greatly stressed while relative displacements or vibrations of the metal layers occur, particularly during bending vibrations. A high proportion of vibrational energy is thereby dissipated via the material damping of the material of the damping layer. The dissipation of structure-borne noise energy thus leads to damping of vibrational modes of the fuel distributor, and thus indirectly to a reduction in the airborne noise connected to it. In addition, the associated structure-borne noise components are able to be reduced which are transmitted via the vibrational modes at the mounting supports and thus by the fuel distributor into the externally-mounted structure. This corresponds to a partial insulation of the fuel distributor from the externally-mounted structure.

The properties of the elastically deformable damping layer, especially a thickness or the material properties, are able to be adjusted with regard to some optimizing parameters, particularly of the frequency contents to be damped and the temperature. The damping layer may be designed to be made of rubber, particularly a natural rubber or a synthetic rubber. The damping layer may also be designed to be of a polymer, particularly a thermoplastic elastomer or a pure thermoplastic. If a plurality of damping layers are provided, by a combination of different materials an additional adjustment of the properties of the damping composite element to the respective application case may take place.

The damping composite elements, may be adjusted, with regard to their geometric design, to a plurality of different fuel distributors and mounting supports. It is particularly advantageous that the mounting support is designed as a sheet metal mounting support and/or as a bridge. The damping composite element may then be connected over its full surface to an upper side of the mounting support. This brings about an especially high damping effect in combination with a planar, thin-walled base structure of mounting support and damping composite element. A strong connection between the damping composite element and the mounting support may thereby be achieved.

The design of the damping composite element may advantageously be adapted, with respect to the layer construction, to the respective application case. According to one advantageous embodiment, the damping composite element is made up of exactly one metal layer and one elastically deformable damping layer, especially an elastomer layer, connected to the metal layer. An adhesive layer is applied to the damping layer. The application of the adhesive layer may also take place before a combined cutting and bending step, which makes production easier. By adhering the damping composite element to the mounting support and/or the fuel distributor, the damping layer then lying internal, so-to-speak forms a damping intermediate layer.

According to one further advantageous embodiment, the damping composite element has an internal damping layer, especially a viscoelastic damping layer. The damping composite element, in this case, is made preferably of exactly two metal layers and an additional damping layer oriented to the mounting support or to the fuel distributor. On the damping layer oriented towards the mounting support or the fuel distributor, an adhesive layer is additionally applied. The application of the adhesive layer may also take place before a combined cutting and bending step, which makes production easier. The damping composite element is connected to the mounting support or the fuel distributor via the adhesive layer.

Different joining concepts are possible for the connection of the damping composite element to the mounting support or the fuel distributor. The damping composite element is preferably joined by its surface after the soldering process, in which the mounting support is connected to the fuel distributor. In this instance, the connection between the damping composite element and fuel distributor or the mounting support is able to take place by an applied adhesive layer. Preferably an adhesive layer is applied ahead of time to the damping composite element, in this case. Then the damping composite element, having the applied adhesive layer on it, may be converted and subsequently applied onto the outside of the fuel distributor or on the upper side of the mounting support and adhered there.

It is also possible to have a vulcanization of the damping composite element on the upper side of the mounting support or the outer side of the fuel distributor. In this case, the damping composite element is preferably converted and then fixed in a device in common with the fuel distributor as well as the mounting support, so that a gap is created between the two joining partners. The raw material for the damping layer used as connecting layer is then conducted into the gap and hardened in a subsequent process step. In this instance, one may particularly use an elastomer raw material. The damping layer formed by this is then a component of the damping composite element. In this embodiment, especially first only a piece of sheet metal or the like, which forms a metal layer, may be positioned with regard to the fuel distributor and the mounting support, and subsequently, by introducing the raw material, the elastically deformable damping layer of the damping composite element may be embodied. In this embodiment the damping layer then enables an advantageous damping effect, and at the same time forms the connection to the fuel distributor or the mounting support. Modifications in the production are also possible, however.

In one advantageous manner, one or more damping composite element may be mounted in a suitable geometric design and suitable positioning on the mounting support and/or the fuel distributor. A damping composite element may in principle be mounted on all surfaces of the mounting support or the fuel distributor. For this purpose, it is advantageous that the damping composite element be designed to be adapted to the outer contour of the joining partner. This may be prepared by a suitable combined cutting and bending process. From an acoustical point of view it is of advantage that the damping composite elements be mounted on thin mounting supports. The mounting supports may be designed as thin sheet metal parts. The degree of overlapping is preferably as great as possible, in this connection. It is particularly advantageous that a damping composite element cover the upper side of the associated mounting support at least approximately over the whole surface. It is also advantageous that a mounting support be provided that is made up of a large area sheet metal blank in the form of a bridge, having a plurality of fastening points. This makes possible the fastening of the fuel distributor to a single mounting support, onto which a correspondingly formed damping composite element is applied. Thereby, continual modes of vibration, such as bending vibrations of a pipe-shaped base body of the fuel distributor are able to be damped. The damping composite elements may also be applied on the outer side of a pipe-shaped base body of the fuel distributor, in which case these then preferably extend along the longitudinal axis of the fuel distributor and are connected to the outer side of the fuel distributor. Consequently, in this embodiment the damping composite element is able to extend, at least essentially, over the entire length of a fuel distributor designed as a common injection rail.

Depending on the embodiment of the system, particularly of the fuel-injection system, substantial advantages thus come about. By the use of the damping composite elements applied onto the surface, having at least one elastically deformable damping layer, vibrations of the fuel distributor may be damped more greatly, whereby the sound radiation from an outer side of the fuel distributor is reduced.

Furthermore, noise transmissions from the fuel distributor to the externally-mounted structure may be reduced. A partial decoupling may be obtained in this manner.

The vibration stress of the fuel distributor and of the high pressure injectors based on the vibration stress of the engine is reduced, since the vibration transmission is damped in this direction as well. This creates advantages with regard to the design and the reliability of these components.

Furthermore, the damping composite element may be used in a simple manner in existing systems, no adaptations, or only slight ones being required. This brings about a broad range of applications.

Advantages with respect to mechanical stability and the like, such as are possible in the case of rigid screwing together of the fuel distributors, may also be achieved, at least essentially.

In addition, an existing assembly and service concept may be taken over, unchanged to a great extent, so that a cost-effective implementation becomes possible.

DETAILED DESCRIPTION

Figure 1:
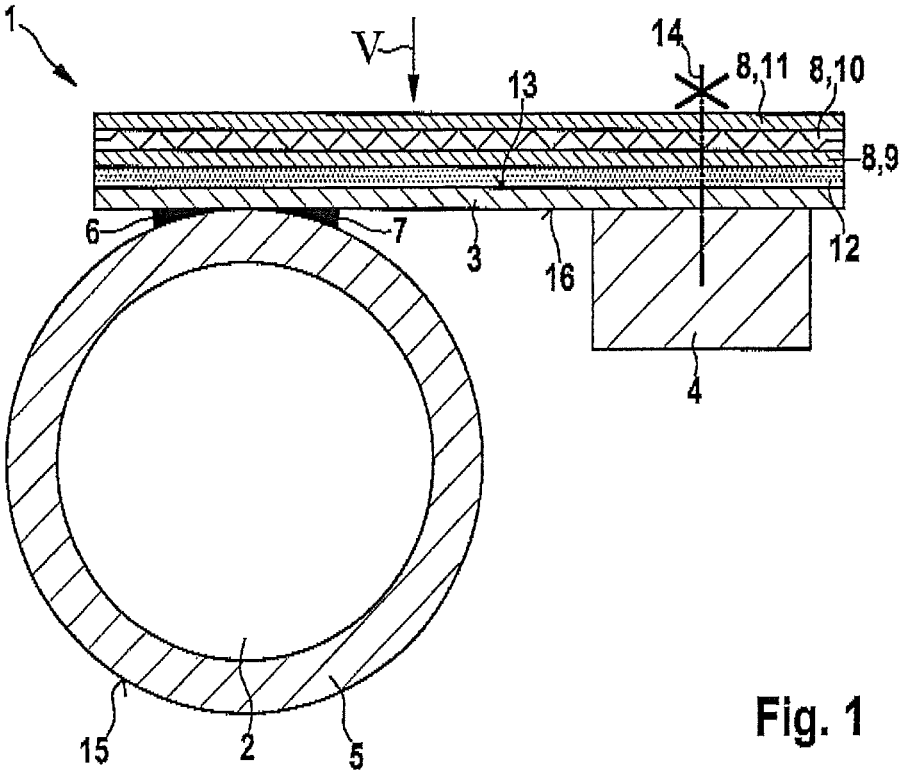
FIG. 1 shows a system having a fuel distributor and a mounting support, which is used to fasten the fuel distributor on an externally-mounted structure, in an excerpted, schematic sectional representation corresponding to a first exemplary embodiment of the present invention.

FIG. 1 shows a system 1 having a fuel distributor 2 and a mounting support 3, which is used to fasten the fuel distributor 2 on an externally-mounted structure 4, in an excerpted, schematic sectional representation corresponding to a first exemplary embodiment. System 1 may be particularly designed as a fuel-injection system for high-pressure injection in internal combustion engines. Externally-mounted structure 4 may be an internal combustion engine, in particular. The externally-mounted structure 4 may especially be a cylinder head of an internal combustion engine 4. System 1 is particularly suitable for mixture-compressing, externally supplied ignition internal combustion engines.

In this exemplary embodiment, fuel distributor 2 has a pipe-shaped base body 5. In this case, fuel distributor 2 is designed as a common injection rail 2, which stores a fuel quantity under high pressure and leads to a plurality of fuel injectors that are not shown. Mounting support 3 is connected to fuel distributor 2 in a suitable manner. In this exemplary embodiment, mounting support 3 is soldered to fuel distributor 2, soldering points 6, 7 being shown for illustration. The soldering together may take place in a conveyor furnace, in this instance.

System 1 also has a damping composite element 8. Damping composite element 8 is connected to mounting support 3. The connection of damping composite element 8 to mounting support 3 preferably takes place after the producing of the connection between mounting support 3 and fuel distributor 2. This prevents a thermal impairment of damping composite element 8.

Damping composite element 8, in this exemplary embodiment, has a metal layer 9, which is formed at least essentially of a metallic material, an elastically deformable damping layer 10 and an additional metal layer 11, which is formed at least essentially of a metallic material. In this exemplary embodiment, damping layer 10 is situated between metal layers 9, 11. Damping layer 10 is connected on one side to metal layer 9, and on the other side to metal layer 11. The connection of damping layer 10 to metal layers 9, 11 may be made by lamination or vulcanization.

In addition, an adhesive layer 12 is provided between damping composite element 8 and mounting support 3. Adhesive layer 12 may first be mounted on damping composite element 8, in this case. Then, damping composite element 8 may first be cut to size using adhesive layer 12, for instance by a stamping process, and then connected to the upper side 13 of mounting support 3.

Mounting support 3 is preferably formed of sheet metal. Damping composite element 8 is preferably connected over the whole surface to upper side 13 of mounting support 3. In this exemplary embodiment, accordingly, adhesive layer 12 is also designed over as full a surface as possible between damping composite element 8 and mounting support 3.

The fastening of fuel distributor 2 to externally-mounted structure 4 may take place via one or more fastening elements 14. Fastening element 14 may particularly be designed as a screw 14.

Consequently, damping layer 10 and metal layers 9, 11 may be connected to one another as one material. In addition, a connection of damping composite element to upper side 13 of mounting support 3 may be achieved via adhesive layer 12. In this exemplary embodiment, metal layer 9 of damping composite element 8 is connected to upper side 13 of mounting support 3 via adhesive layer 12.

In a corresponding manner, a damping composite element 8 may also be connected to fuel distributor 2. A damping composite element 8 may especially also be applied to outer side of pipe-shaped base body 5. An application onto mounting support 3 and onto fuel distributor 2 are also possible. In this case, damping composite element 8 is then partly connected to outer side 15 of fuel distributor 2 and partly to upper side 13 of mounting support 3. Furthermore, a damping composite element 8 may also be applied to an under side 16 of mounting support 3. Moreover, a plurality of damping composite elements 8 may be connected to fuel distributor 2 and/or mounting support 3.

Figure 2:
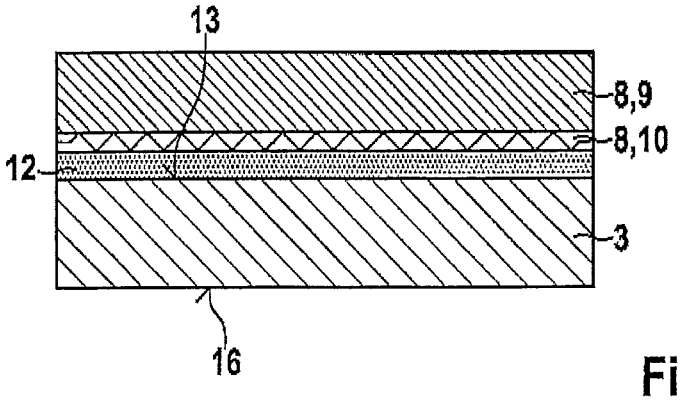
FIG. 2 shows a damping composite element and a mounting support of the system shown in FIG. 1, in excerpted, schematic sectional view, corresponding to a second exemplary embodiment of the present invention.

FIG. 2 shows a damping composite element 8 and a mounting support of system 1 shown in FIG. 1 according to a second exemplary embodiment in an excerpted schematic representation. In this exemplary embodiment, damping composite element 8 is made up of metal layer 9 and elastically deformable damping layer 10. In this exemplary embodiment, elastically deformable damping layer 10 is connected to upper side 13 of mounting support 3 via adhesive layer 12. Thereby the embodiment using exactly one metal layer 9 and exactly one damping layer 10 is possible. Elastically deformable damping layer 10 is thereby protected by metal layer 9 from the environment.

Figure 3:
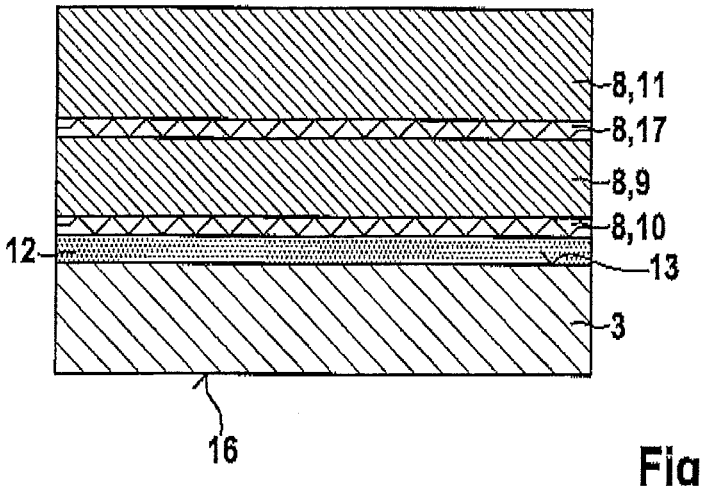
FIG. 3 shows the damping composite element and the mounting support shown in FIG. 2, in excerpted, schematic sectional view, corresponding to a third exemplary embodiment of the present invention.

FIG. 3 shows damping composite element 8 shown in FIG. 2 and mounting support 3 corresponding to a third exemplary embodiment. In this exemplary embodiment, damping composite element 8 has metal layer 9, additional metal layer 11, elastically deformable damping layer 10 and an additional elastically deformable damping layer 17. In this case, additional elastically deformable damping layer 17 is situated between metal layers 9, 11. Elastically deformable damping layer 10 is connected to metal layer 9 on one side and on the other side it faces mounting support 3. In this exemplary embodiment, damping layer 10 is connected to upper side 13 of mounting support 3 via adhesive layer 12. Thereby damping composite element 8, which is formed from metallic layers 9, 11 and damping layers 10, 17, is connected to mounting support 3.

In a corresponding manner, a damping composite element 8 may be embodied to have a plurality of metal layers 9, 11 and a plurality of damping layers 10, 17. This makes possible an adaptation to the respective application case. Metal layers 9, 11 may perhaps also be formed of different metallic materials, in this instance. Damping composite elements 8, 17 may particularly be formed of a material based on rubber or a polymer. In this context, damping layers 10, 17 may also be formed of different materials.

Figure 4:
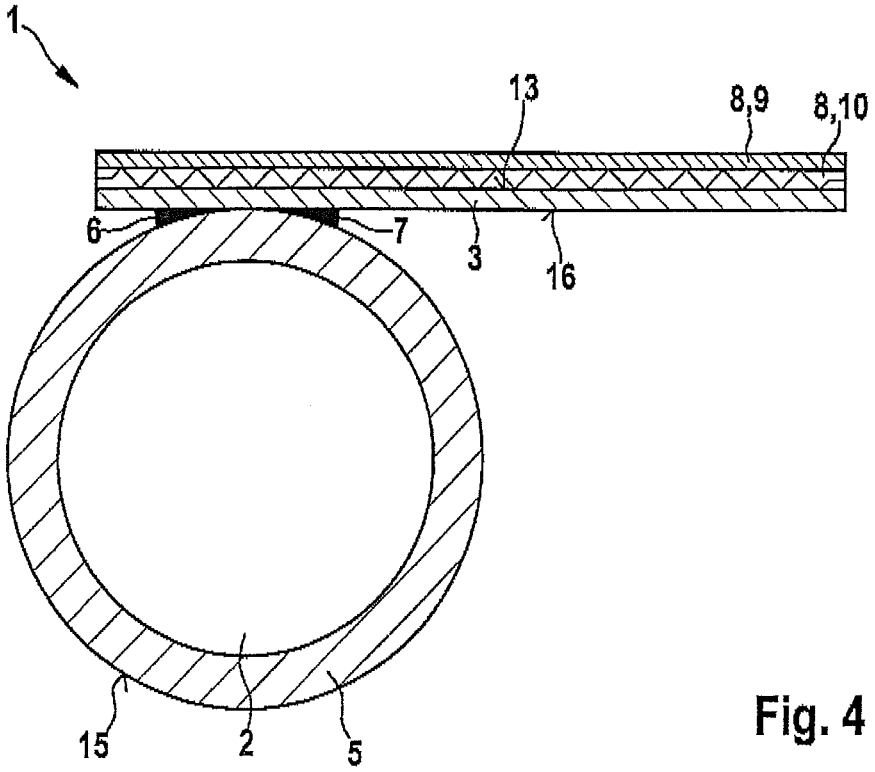
FIG. 4 shows the system shown in FIG. 1, in excerpted, schematic sectional view, corresponding to a fourth exemplary embodiment of the present invention.

FIG. 4 shows system 1 shown in FIG. 1, in excerpted, schematic sectional view, corresponding to a fourth exemplary embodiment. In this exemplary embodiment, damping composite element 8 has metal layer 9 and elastically deformable damping layer 10. In this instance, elastically deformable damping layer 10 is directly connected to upper side 13 of mounting support 3. This may be achieved by a subsequent vulcanization of damping layer 10.

For instance, mounting support 3 that is connected to fuel distributor 2 may be fixed together with metal layer 9 via a suitable device. In this connection, a specified gap is set between the two joining partners, that is, on one side metal layer 9 and on the other side mounting support 3. This gap is then filled using the material for embodying damping layer 10. In this instance, one may particularly use an elastomer raw material. After hardening, damping composite element 8 is then formed from metal layer 9 and damping layer 10. Furthermore, damping layer 10 is then connected on one side to metal layer 9, and on the other side to mounting support 3.

Consequently, the damping layer of the damping composite element is able to be combined with the mounting support and/or the fuel distributor by vulcanization.

Figure 5:
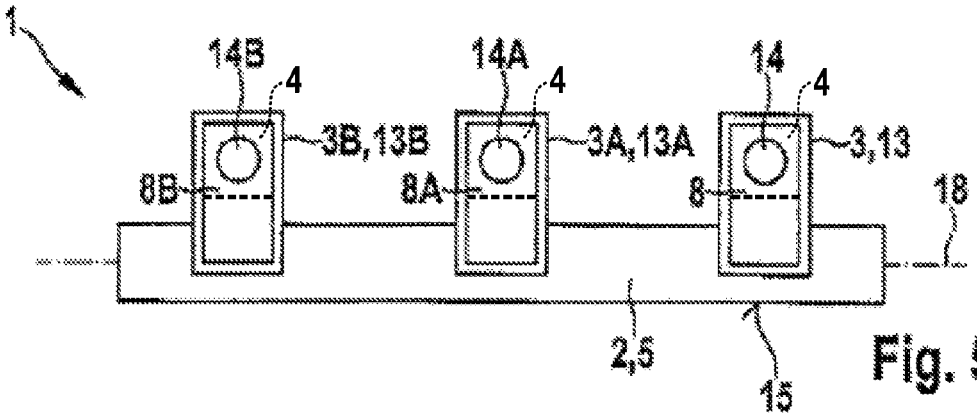
FIG. 5 shows the system shown in FIG. 1, as seen from a direction of view designated by V, in a schematic view corresponding to a fifth exemplary embodiment of the present invention.

FIG. 5 shows system 1 shown in FIG. 1 in a schematic representation from the direction of view designated by V, corresponding to a fifth exemplary embodiment. Mounting support 3 is preferably formed of strip-shaped sheet metal. In this connection, a suitable through hole is embodied in mounting support 3, through which fastening element 14 extends. In this exemplary embodiment, upper side 13 is connected, approximately over the full surface, to damping composite element 8.

In addition, further mounting supports 3A, 3B are provided. The upper sides 13A, 13B of additional mounting supports 3A, 3B are provided approximately over the full surface with additional damping composite elements 8A, 8B. Thus, a vibration damping is ensured at each mounting support 3, 3A, 3B. Mounting supports 3A, 3B are screwed to externally-mounted structure 4, via additional fastening elements 14A, 14B.

Mounting supports 3, 3A, 3B are situated distributed along a longitudinal axis 18 on pipe-shaped base body 5 and soldered to pipe-shaped base body 5.

Figure 6:
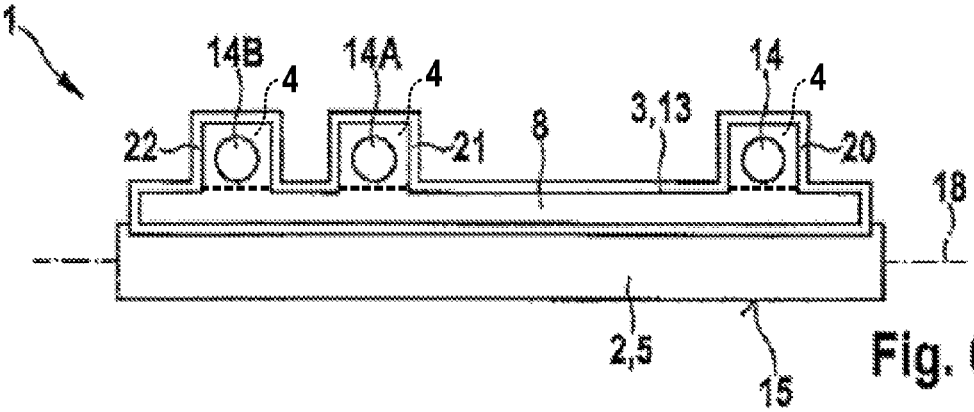
FIG. 6 shows the system shown in FIG. 5, in a schematic view, corresponding to a sixth exemplary embodiment of the present invention

FIG. 6 shows system 1 shown in FIG. 5, in a schematic representation, corresponding to a sixth exemplary embodiment. In this exemplary embodiment, mounting support 3 is formed from a large-surface sheet metal blank, which extends at least essentially over the entire length of pipe-shaped base body 5 of fuel distributor 2. Tabs 20, 21, 22 are embodied on mounting support 3. On each tab 20 to 22 one is able to fasten mounting support 3 to externally-mounted structure 4, using fastening elements 14, 14*a*, 14B Damping composite element 8 is connected over approximately the whole surface to upper side 13 of mounting support 3. Because of that, damping composite element 8 also extends along axis 18, over nearly the entire length of pipe-shaped base body 5 of fuel distributor 2 embodied as fuel manifold 2. Hereby continual vibrating forms, such as bending vibrations of pipe-shaped base body 5, may also be damped.

Figure 7:
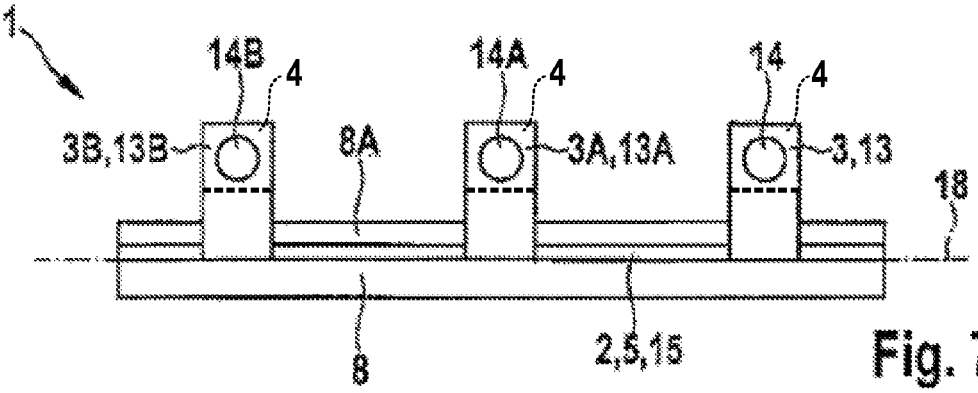
FIG. 7 shows the system shown in FIG. 5, in a schematic view, corresponding to a seventh exemplary embodiment of the present invention.
Figure 8:
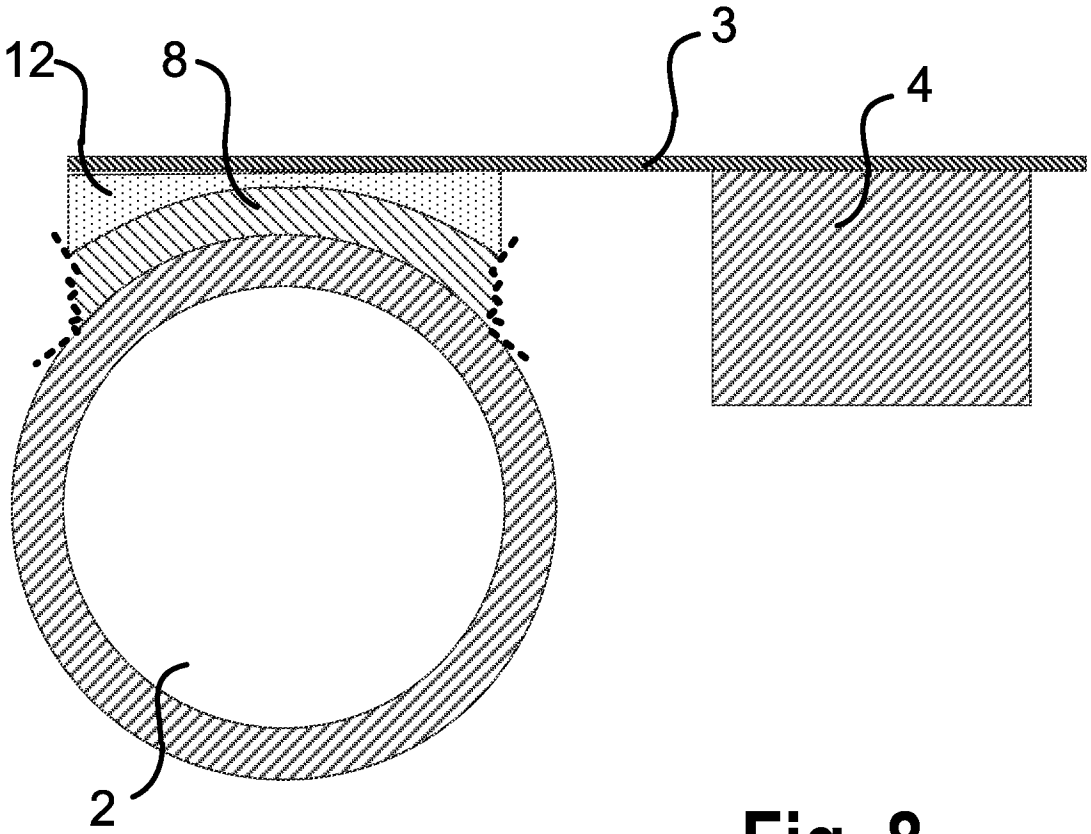
FIG. 8 shows a damping composite element circumferentially wrapped around a portion of an outer surface of a fuel distributor, according to an example embodiment of the present invention.

FIG. 7 shows system 1 shown in FIG. 5, in a schematic representation, corresponding to a seventh exemplary embodiment. In this exemplary embodiment, fuel distributor 2 is also embodied as a fuel manifold 2, which extends along longitudinal axis 18. Damping composite element 8 extends along longitudinal axis 18 of fuel distributor 2 and is connected to outer side 15 of pipe-shaped base body 5 of fuel distributor 2. Besides that, in this exemplary embodiment a still further damping composite element 8A is provided, which also extends along longitudinal axis 18 of fuel distributor 2, and is connected to outer side 15 of pipe-shaped base body 5 of fuel distributor 2. In this case, the embodiment of damping composite element 8 may also be a bending shape, which at least extensively encloses the pipe-shaped base body 5 of fuel distributor 2 circumferentially, as shown in FIG. 8. The function of the two damping composite element 8, 8A may then be achieved by a single damping composite element 8. In this case, however, suitable recesses for rail bucket tappets or for connecting lines leading to the fuel injectors are required.

The present invention is not limited to the exemplary embodiments described.

What is claimed is:

1. A system, comprising:

a fuel distributor;

a first attachment structure;

a second attachment structure;

a mounting support by which the fuel distributor is simultaneously and independently fastened to a first attachment structure by an attachment of the first attachment structure to the mounting support at a first attachment point and to a second attachment structure by an attachment of the second attachment structure to the mounting support at a second attachment point, the attachments of the first and second attachment structures at the first and second attachment points, respectively, being independent of each other; and a damping composite element connected to the mounting support and the fuel distributor;

wherein:

the damping composite element includes:

at least one metal layer formed of a metallic layer; and at least one elastically deformable damping layer; and the mounting support is arranged relative to the fuel distributor so that:

the fuel distributor and the first and second attachment structures are positioned at a same first side of the mounting support;

no part of the fuel distributor and no part of the first and second attachment structures are at respective second sides of the mounting support that are respectively opposite the respective first sides;

in each of at least one plane, positions of the fuel distributor and the first and second attachment structures (a) are offset from each other with respect to a first axis so that, in the each of the at least one plane, no coordinate of the first axis is shared by both the fuel distributor and the first and second attachment structures and (b) overlap each other with respect to a second axis that is perpendicular to the first axis so that, in the each of the at least one plane, a first coordinate of the second axis is shared by both the fuel distributor and the first attachment structure and a second coordinate of the second axis is shared by both the fuel distributor and the second attachment structure; and the damping composite element (a) circumferentially wraps around at least a portion of an outer surface of the fuel distributor and (b) extends axially in a direction parallel to the second axis from (i) the first attachment point, which is at the first coordinate of the second axis shared by the fuel distributor and the first attachment structure to (ii) the second attachment point, which is at the second coordinate of the second axis shared by the fuel distributor and the second attachment structure.

2. The system of claim 1, wherein, in the each of the at least one plane, no coordinate of the second axis is shared by both of the first and second attachment structures.

3. A system, comprising:

a fuel distributor;

at least one mounting support for simultaneously fastening the fuel distributor to a first attachment structure and a second attachment structure; and a damping composite element connected to the at least one mounting support and the fuel distributor;

wherein:

the damping composite element includes:

at least one metal layer formed of a metallic layer; and at least one elastically deformable damping layer; and the at least one mounting support is arranged relative to the fuel distributor for positioning of the fuel distributor and the first and second attachment structures at a same first side of the at least one mounting support when the fuel distributor and the first and second attachment structures are fastened to each other by the at least one mounting support, so that, when the fuel distributor and the first and second attachment structures are fastened to each other by the at least one mounting support:

no part of the fuel distributor and no part of the first and second attachment structures are at respective second sides of the at least one mounting support that are respectively opposite the respective first sides;

in at least one plane, positions of the fuel distributor and the first and second attachment structure (a) are offset from each other with respect to a first axis so that, in the at least one plane, no coordinate of the first axis is shared by both the fuel distributor and the first and second attachment structures and (b) overlap each other with respect to a second axis that is perpendicular to the first axis so that, in the at least one plane, at least one coordinate of the second axis is shared by both the fuel distributor and the first and second attachment structures; and the damping composite element (a) circumferentially wraps around at least a portion of an outer surface of the fuel distributor and (b) extends axially in a direction parallel to the second axis from (i) a first coordinate of the second axis shared by the fuel distributor and the first attachment structure and at which the first attachment structure is attached to the at least one mounting support to (ii) a second coordinate of the second axis shared by the fuel distributor and the second attachment structure and at which the second attachment structure is attached to the at least one mounting support;

the circumferential wrapping is about a longitudinal axis that is or is parallel to the second axis, in the at least one plane;

no coordinate of the second axis occupied by the first attachment structure is occupied by the second attachment structure; and at least a portion of the fuel distributor, at least a portion of the first attachment structure, and at least a portion of the second attachment structure are present in each of the at least one plane.

4. The system as recited in claim 3, wherein, in the at least one plane, the positions of the first and second attachment structure overlap each other with respect to the first axis, so that at least one coordinate of the first axis is shared by both of the first and second attachment structures.

5. A system, comprising:

a fuel distributor;

a mounted structure;

a layered structure that includes a mounting support layer and layers forming a damping composite element;

wherein:

the layers forming the damping composite element include a metal layer and an elastically deformable damping layer;

the mounting support layer and the damping composite element layers all extend laterally, in a first direction, from (a) a first lateral coordinate at which a upper side of an outer surface of the fuel distributor is attached to a bottom side of the mounting support layer or a bottom side of the damping composite element to (b) a second lateral coordinate at which an upper side of the mounted structure is attached to the bottom side of the mounting support layer or the bottom side of the damping composite element, the fuel distributor and the mounted structure thereby being fastened to each other via the layered structure;

at the first lateral coordinate, a longitudinal axis of the fuel distributor extends in a second direction that is perpendicular to the first direction; and at the first and second lateral coordinates, respectively, the fuel distributor and the mounted structure are, in a third direction that is perpendicular to the first and second directions, below an underside of the layered structure, and no part of the fuel distributor and no part of the mounted structure is over an upper side of the layered structure in the third direction.

6. The system as recited in claim 5, wherein no part of the fuel distributor is above any part of the layered structure and no part of the mounted structure is above any part of the layered structure.

7. The system as recited in claim 5, wherein the metal layer and the damping layer are connected to each other as a continuous material.

8. The system as recited in claim 5, further comprising:

an adhesive layer, wherein the metal layer of the damping composite element is connected to at least one of the mounting support layer and the fuel distributor via the adhesive layer.

9. The system as recited in claim 5, further comprising:

an adhesive layer, wherein the damping layer of the damping composite element is connected to at least one of the mounting support layer and the fuel distributor via the adhesive layer.

10. The system as recited in claim 5, wherein the damping layer of the damping composite element is connected to at least one of the mounting support layer and the fuel distributor by vulcanizing.

11. The system as recited in claim 5, wherein the damping layer includes a material based on rubber.

12. The system as recited in claim 5, wherein at least one of: the mounting support layer is connected to the fuel distributor as a continuous material, and the mounting support is soldered to the fuel distributor.

13. The system as recited in claim 5, wherein the damping composite element at least one of:

includes at least one further metal layer that includes a metallic material of the metal layer, and includes at least one further damping layer that is elastically deformable and formed of a material based on one of a rubber and a polymer.

14. The system as recited in claim 5, wherein:

the mounting support layer includes a sheet metal, and the damping composite element is connected at least approximately over a full surface thereof to an upper side of the mounting support layer.

15. The system as recited in claim 5, wherein:

the fuel distributor includes a fuel manifold, and the damping composite element extends along the longitudinal axis of the fuel distributor and is connected to the outer surface of the fuel distributor.

16. The system as recited in claim 5, wherein the system is a fuel injection system for a high-pressure injection in an internal combustion engine.

17. The system of claim 5, wherein the mounting support layer is formed of sheet metal and the damping composite element is connected approximately over its full surface to an upper side of the mounting support layer.

18. The system of claim 17, wherein the system is a fuel injection system for a high-pressure injection in an internal combustion engine.

19. The system as recited in claim 5, wherein a portion of the mounting support layer is arranged between the damping composite element and the mounted structure.

20. The system as recited in claim 5, wherein respective portions of the mounting support layer are arranged between the damping composite element and each of the fuel distributor and the mounted structure.

21. The system as recited in claim 5, wherein a bottom surface of the damping composite element is flat.

22. The system as recited in claim 5, wherein at least a portion of the mounting support layer is arranged between at least a portion of the damping composite element and at least a portion of the fuel distributor, so that the at least the portion of the damping composite element, the at least the portion of the mounting support layer, and the at least the portion of the fuel distributor are all positioned at at least one same coordinate of an axis that is parallel to the first direction.

23. The system as recited in claim 5, wherein the mounted structure is an internal combustion engine cylinder head.

24. The system as recited in claim 5, wherein the mounting support layer and the damping composite element are arranged so that:

in at least one plane, the mounted structure and the fuel distributor are laterally offset from each other in the first direction;

at the second lateral coordinate, the damping composite element is, in the third direction, over at least a portion of the mounted structure in the at least one plane and not over any portion of the fuel distributor in the at least one plane; and at the first lateral coordinate, the damping composite element is, in the third direction, over at least a portion of the fuel distributor in the at least one plane and not over any portion of the mounted structure in the at least one plane.

25. The system as recited in claim 24, wherein at least one of the damping composite element and the mounting support layer extends in the second direction from (a) a first axial position at which the mounted structure is fastened to the fuel distributor by the layered structure to (b) a second axial position at which a second mounted structure is simultaneously fastened to the fuel distributor by the layered structure.

26. The system as recited in claim 5, wherein the mounting support layer and the damping composite element are arranged so that:

the mounted structure and the fuel distributor are laterally offset from each other in the first direction;

at the second lateral coordinate, the damping composite element is, in the third direction, over the mounted structure and not over the fuel distributor; and at the first lateral coordinate, the damping composite element is, in the third direction, over the fuel distributor and not over the mounted structure.

27. The system as recited in claim 5, wherein at least a portion of the metal layer and at least a portion of the elastically deformable damping layer of the damping composite element are positioned, in the third direction, over at least the portion of the mounted structure, and at least a portion of the metal layer and at least a portion of the elastically deformable damping layer of the damping composite element are positioned, in the third direction, over at least the portion of the fuel distributor.

28. A method for producing a system that including (a) a layered structure that includes a mounting support layer and layers forming a damping composite element, (b) a fuel distributor, and (c) a mounted structure, the method comprising:

integrally connecting the mounting support layer to the fuel distributor by soldering or welding;

connecting the damping composite element at least approximately over its full surface to an upper side of the mounting support; and connecting the mounted structure to the mounting support layer;

wherein:

the layers forming the damping composite element include a metal layer and an elastically deformable damping layer; and the connecting steps are performed such that:

the mounting support layer and the damping composite element layers all extend laterally, in a first direction, from (a) a first lateral coordinate at which a upper side of an outer surface of the fuel distributor is attached to a bottom side of the mounting support layer to (b) a second lateral coordinate at which an upper side of the mounted structure is attached to the bottom side of the mounting support layer, the fuel distributor and the mounted structure thereby being fastened to each other via the layered structure;

at the first lateral coordinate, a longitudinal axis of the fuel distributor extends in a second direction that is perpendicular to the first direction; and at the first and second lateral coordinates, respectively, the fuel distributor and the mounted structure are, in a third direction that is perpendicular to the first and second directions, below an underside of the layered structure, and no part of the fuel distributor and no part of the mounted structure is over an upper side of the layered structure in the third direction.

29. The method of claim 28, wherein the system is a fuel injection system for a high-pressure injection in an internal combustion engine.

30. The method of claim 28, wherein the damping layer is connected to the metal layer by lamination or vulcanization.

31. The method of claim 30, wherein an adhesive layer is provided between the damping composite element and the mounting support layer.

32. The method of claim 28, wherein an adhesive layer is provided between the damping composite element and the mounting support layer.

* * * * *